US012808163B2

(12) United States Patent
Vazquez

(10) Patent No.: US 12,808,163 B2
(45) Date of Patent: Nov. 24, 2026

(54) METHOD FOR SUPPORTING A LOADING OPERATION

(71) Applicant: DEERE & COMPANY, Moline, IL (US)

(72) Inventor: Jose Israel Vazquez, Monterrey (MX)

(73) Assignee: DEERE & COMPANY, Moline, IL (US)

( * ) Notice: Subject to any disclaimer, the term of this patent is extended or adjusted under 35 U.S.C. 154(b) by 18 days.

(21) Appl. No.: 19/064,898

(22) Filed: Feb. 27, 2025

(65) Prior Publication Data

US 2025/0290299 A1 Sep. 18, 2025

(30) Foreign Application Priority Data

Mar. 18, 2024 (EP) ..... 24164093

(51) Int. Cl.
*E02F 9/26* (2006.01)

(52) U.S. Cl.
CPC ..... *E02F 9/268* (2013.01)

(58) Field of Classification Search
CPC ..... E02F 9/268
USPC ..... 701/50
See application file for complete search history.

(56) References Cited

U.S. PATENT DOCUMENTS 3,641,551 A * 2/1972 Sterner ..... B66C 23/905 212/277
5,163,570 A * 11/1992 Mundis ..... B66C 23/90 212/278
5,361,211 A * 11/1994 Lee ..... F15B 11/05 701/50
7,049,949 B2 * 5/2006 Champeau ..... B60C 23/002 702/29
7,729,830 B2 * 6/2010 Tarasinski ..... A01D 41/127 701/1
8,065,054 B2 * 11/2011 Tarasinski ..... B60N 2/39 340/407.1
8,355,847 B2 * 1/2013 Colwell ..... E02F 3/432 318/568.22

(Continued)

FOREIGN PATENT DOCUMENTS

CN 115573410 B 3/2023

OTHER PUBLICATIONS

European Search Report in application No. 24164093.7, dated Sep. 18, 2024, 10 pages.

(Continued)

*Primary Examiner* — Luis A Martinez Borrero

(57) ABSTRACT

A method for supporting a loading operation, in which a front loader is arranged on a utility vehicle and includes a loading tool for picking up a load material and a hydraulically adjustable loader linkage for pivoting and for raising and lowering the loading tool, includes monitoring via a control unit during the execution of a loading operation whether a travel state that indicates instantaneous or intended forward travel of the utility vehicle would lead to a potential overload state of a travel drive provided for carrying out forward travel, and automatically via the control unit put and keep the utility vehicle in a drive-neutral stationary state in a loading assistance mode by intervening in one or more of a drive and brake management system when the travel state would lead to the potential overload state.

17 Claims, 2 Drawing Sheets

(56) References Cited

U.S. PATENT DOCUMENTS

| | | | | |
|---|---|---|---|---|
| 8,620,536 | B2 * | 12/2013 | Colwell | E02F 9/265 318/568.22 |
| 9,260,834 | B2 * | 2/2016 | Lee | E02F 3/46 |
| 9,267,263 | B2 * | 2/2016 | Bertrand | E02F 3/422 |
| 9,708,165 | B2 * | 7/2017 | Öberg | E02F 3/3681 |
| 11,396,231 | B2 * | 7/2022 | Burjes | B60K 17/28 |
| 11,396,295 | B2 * | 7/2022 | Ikenori | B60T 7/22 |
| 12,385,224 | B2 * | 8/2025 | Naruo | E02F 9/2207 |
| 2002/0193924 | A1 * | 12/2002 | Muller | F15B 15/14 701/50 |
| 2004/0136816 | A1 * | 7/2004 | Pulli | B65G 67/24 414/340 |
| 2006/0015231 | A1 * | 1/2006 | Yoshimura | B60K 6/46 701/1 |
| 2007/0083312 | A1 * | 4/2007 | Lehnen | E02F 9/085 701/50 |
| 2008/0275596 | A1 * | 11/2008 | Tarasinski | E02F 9/2004 701/1 |
| 2009/0018730 | A1 * | 1/2009 | Tarasinski | A01D 41/127 701/50 |
| 2010/0036568 | A1 | 2/2010 | Filla | |
| 2012/0290178 | A1 * | 11/2012 | Suzuki | E02F 9/265 701/50 |
| 2015/0032337 | A1 * | 1/2015 | Nakamura | B60T 8/17 701/50 |
| 2016/0060841 | A1 * | 3/2016 | Morinaga | E02F 3/40 37/444 |
| 2016/0281323 | A1 * | 9/2016 | Imaizumi | E02F 9/2296 |
| 2017/0079195 | A1 * | 3/2017 | Yokoyama | A01B 69/008 |
| 2017/0210372 | A1 * | 7/2017 | Feigel | B60T 7/12 |
| 2017/0247860 | A1 * | 8/2017 | Lehtinen | E02F 9/2041 |
| 2018/0170337 | A1 * | 6/2018 | Abrahamsson | B60T 13/20 |
| 2019/0100218 | A1 * | 4/2019 | Kim | B60T 13/686 |
| 2019/0376259 | A1 | 12/2019 | Pence et al. | |
| 2021/0179063 | A1 * | 6/2021 | Tokura | B60W 20/13 |
| 2021/0362718 | A1 * | 11/2021 | Ikenori | B60W 10/18 |
| 2022/0016974 | A1 * | 1/2022 | Burjes | B60W 10/04 |
| 2024/0133151 | A1 * | 4/2024 | Faivre | E02F 3/34 |
| 2024/0426082 | A1 * | 12/2024 | Li | E02F 3/964 |
| 2025/0198122 | A1 * | 6/2025 | Naruo | E02F 9/2207 |
| 2025/0290289 | A1 * | 9/2025 | Brocke | E02F 9/2062 |

OTHER PUBLICATIONS

Ratchet (device), retrieved from <URL: https://en.wikipedia.org/wiki/Ratchet_(device), on Feb. 24, 2025, 4 pages.

John Deere 310 P-Tier Articulated Dump Truck, retrieved from <URL: https://www.deere.com/en/articulated-dump-trucks/310-p-adt/>, on Feb. 24, 2025, 15 pages.

Volkswagen Electronic parking brake system, retrieved from <URL: https://www.volkswagen.co.uk/en/technology/driver-assist/braking.html>, on Feb. 24, 2025, 6 pages.

* cited by examiner

METHOD FOR SUPPORTING A LOADING OPERATION

CROSS-REFERENCE TO RELATED APPLICATIONS

This application claims priority to European Patent Application No. 24164093.7, filed Mar. 18, 2024, which is hereby incorporated by reference.

FIELD OF THE DISCLOSURE

The disclosure relates to a method for supporting a loading operation.

BACKGROUND

In the agriculture, construction, and forestry industries, various work machines, such as front loaders, may be utilized in lifting and moving various materials. In certain examples, a front loader may include a bucket pivotally coupled by loader arms to the vehicle chassis. One or more hydraulic cylinders move the loader arms and/or the bucket between positions relative to the chassis to lift and move materials.

SUMMARY

The disclosure relates to a method for supporting a loading operation, in which a front loader, which is arranged on a utility vehicle and comprises a loading tool for picking up a load material and a hydraulically adjustable loader linkage for pivoting and for raising and lowering the loading tool, is provided.

Front loaders of this kind are used to transfer, inter alia, bulk load material by means of a loading tool, for example a loading tool designed as a bucket, which is located on a free end of the front loader. In this case, the loading tool or bucket can be adjusted in height relative to the ground and in its inclination about a pivoting axis running transversely to the longitudinal extent of the utility vehicle by actuating hydraulic actuating devices, which are component parts of the loader linkage, thus allowing selective penetration of the bucket into a load material supply for the purpose of filling the bucket. The front loader is attached as a removable accessory unit in the front region of an agricultural tractor, for example, but the latter can also be designed as a bucket excavator, a telescopic loader or some other corresponding loading vehicle from the construction or agricultural sector. The load material primarily comprises bulk materials such as cereals, maize, gravel, sand, soil, or the like.

Owing to the required coordination between the control of the driving movement of the utility vehicle, that is to say the maneuvering of the utility vehicle, and the loading movement of the loading tool which is to be carried out by appropriate actuation of the hydraulically adjustable loader linkage, picking up the load material by means of the loading tool imposes increased demands on the operator. In the case of less experienced operators, it may happen that, depending on the type of load material, the resistance which opposes the driving or penetration of the loading tool into the load material exceeds the capacity of an internal combustion engine used as a travel drive, with the result that, in the least favorable case, said engine stalls.

In view of this, it is the object of the present disclosure to specify a method of the type stated at the outset which takes account of the capacity of an internal combustion engine used as a travel drive when executing a loading operation with a front loader.

This object is achieved by a method for supporting a loading operation having the features of one or more of the embodiments disclosed herein.

In the method provided for supporting a loading operation, a front loader, which is arranged on a utility vehicle and comprises a loading tool for picking up a load material and a hydraulically adjustable loader linkage for pivoting and for raising and lowering the loading tool, is provided, wherein, during the execution of a loading operation, a control unit (e.g., a controller including a processor and memory) monitors whether a travel state that indicates instantaneous or intended forward travel of the utility vehicle would lead to a potential overload state of a travel drive provided for carrying out forward travel in order, in such a case, to automatically put and keep the utility vehicle in a drive-neutral stationary state in a loading assistance mode by intervening in a drive and/or brake management system.

This makes it possible to execute a loading operation with a front loader without the possibility that the resistance posed to the loading tool as it drives or penetrates into the load material will exceed the capacity of an internal combustion engine used as a travel drive.

To implement the drive-neutral stationary state, provision can be made, at the instigation of the control unit, for the drive and/or brake management system to be controlled in such a way that an interruption in the drive connection between the travel drive and the driven wheels of the utility vehicle is brought about while simultaneously actuating associated wheel brake devices. If the travel drive comprises a vehicle transmission in the form of a shift or CVT transmission, the drive connection is typically interrupted by opening a travel clutch. If, on the other hand, an IVT transmission is provided, the travel clutch is omitted and, in this case, the drive-neutral stationary state is achieved by selecting the "infinite" transmission ratio.

In general terms, the drive-neutral stationary state is thus distinguished by the fact that the driven wheels of the utility vehicle are free from driving torques. The actuation of the wheel brake devices ensures that the utility vehicle cannot roll away in this state.

At the same time, it is possible that a travel state that indicates instantaneous or intended forward travel of the utility vehicle is recognized by the control unit by observation of characteristic indications in the form of travel-related driver actions, such as gas pedal or travel lever actuation with a forward gear selected or by evaluation of the direction of rotation of the wheels of the utility vehicle. The relevant information can be detected by sensors and made available to the control unit via a CAN databus, for example.

The front loader is used to transfer inter alia bulk load material by means of a loading tool designed as a bucket or the like, which is located on a free end of the front loader. In this case, the loading tool can be adjusted in height relative to the ground and in its inclination about a pivoting axis running transversely to the longitudinal extent of the utility vehicle by actuating hydraulic actuating devices, which are designed as hydraulic cylinders and are component parts of the loader linkage, allowing selective penetration of the loading tool into a load material supply for the purpose of filling the loading tool. The front loader is attached as a removable accessory unit in the front region of an agricultural tractor, for example, but the latter can also be designed as a bucket excavator, a telescopic loader or some other corresponding loading vehicle from the construction or agricultural sector. The load material primarily comprises bulk materials such as cereals, maize, gravel, sand, soil, or the like.

Advantageous embodiments of the method according to the disclosure can be found in one or more of the embodiments disclosed herein.

The control unit can infer a potential overload state of the travel drive if a resistance posed to the loading tool as the load material is picked up exceeds an overload-specific limit value. If the travel drive comprises an internal combustion engine, the overload-specific limit value is chosen, for example, on the basis of an engine characteristic presupposed as known, typically such that the limit value is characteristic of imminent stalling of the internal combustion engine. The latter is the case when the engine speed to be expected from the injected fuel quantity on the basis of the engine characteristic is not achieved or is undershot.

The control unit can derive the resistance posed to the loading tool as the load material is picked up by evaluating sensor-detected pressure conditions in hydraulic cylinders provided for the adjustment of the loader linkage and/or sensor-detected actuating torques at the loader linkage, in each case on the basis of the instantaneous position of the loader linkage and thus of the leverage ratios resulting therefrom. The sensor detection of the actuating torques can be accomplished by means of strain gages positioned at suitable points in the loader linkage. In addition or as an alternative, it is conceivable to perform an assessment of changes in axle load occurring in this context at a front axle of the utility vehicle, for example by observing a change thus brought about in the tire pressure in the front wheels.

It can furthermore be envisaged that, in the loading assistance mode, the control unit prevents the execution of the loading operation by intervening in a hydraulic control system at least until achievement of the drive-neutral stationary state has been detected. The hydraulic control system can then be enabled, such that the loading operation can be continued by the driver. In addition, there is the possibility that the drive-neutral stationary state is cancelled as soon as the control unit detects that a potential overload state of the travel drive is no longer to be expected. In this case, forward travel can be resumed in order to penetrate further into the load material by means of the loading tool, wherein the loading assistance mode continues to be active. If a potential overload state of the travel drive is detected again, the process described above begins again from the start. This repeated process leads to the load material being picked up bit by bit by means of the loading tool and, to this extent, can also be characterized as "ratchet digging".

It is also conceivable that, in the loading assistance mode, driver information that indicates the potential overload state of the travel drive is output by means of a user interface that can be driven by the control unit, wherein the output of the driver information is cancelled or modified when achievement of the drive-neutral stationary state is detected. The driver information can be output, for example, in the form of a traffic light, which is shown on a display of the user interface and which switches from red to green when the functional limitation is lifted, and vice versa. Such a way of displaying information can be particularly easy for the driver to grasp intuitively.

The above and other features will become apparent from the following detailed description and accompanying drawings.

BRIEF DESCRIPTION OF THE DRAWINGS

The method according to the disclosure will be explained in more detail hereinafter on the basis of the appended drawings, in which.

DETAILED DESCRIPTION

The embodiments or implementations disclosed in the above drawings and the following detailed description are not intended to be exhaustive or to limit the present disclosure to these embodiments or implementations.

Figure 1:
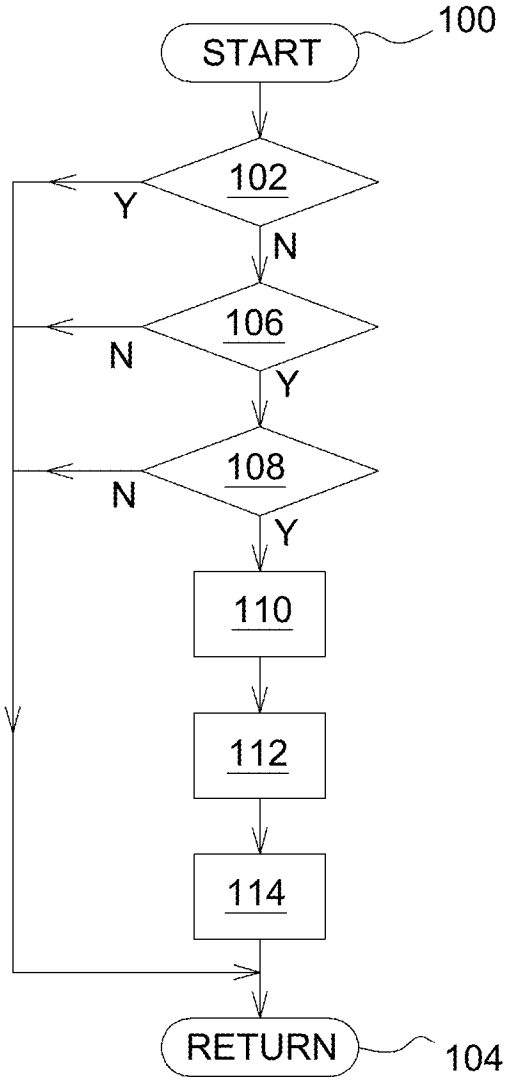
FIG. 1 shows an example embodiment, illustrated as a flow diagram, of the method according to the disclosure for supporting a loading operation with a front loader.
Figure 2:
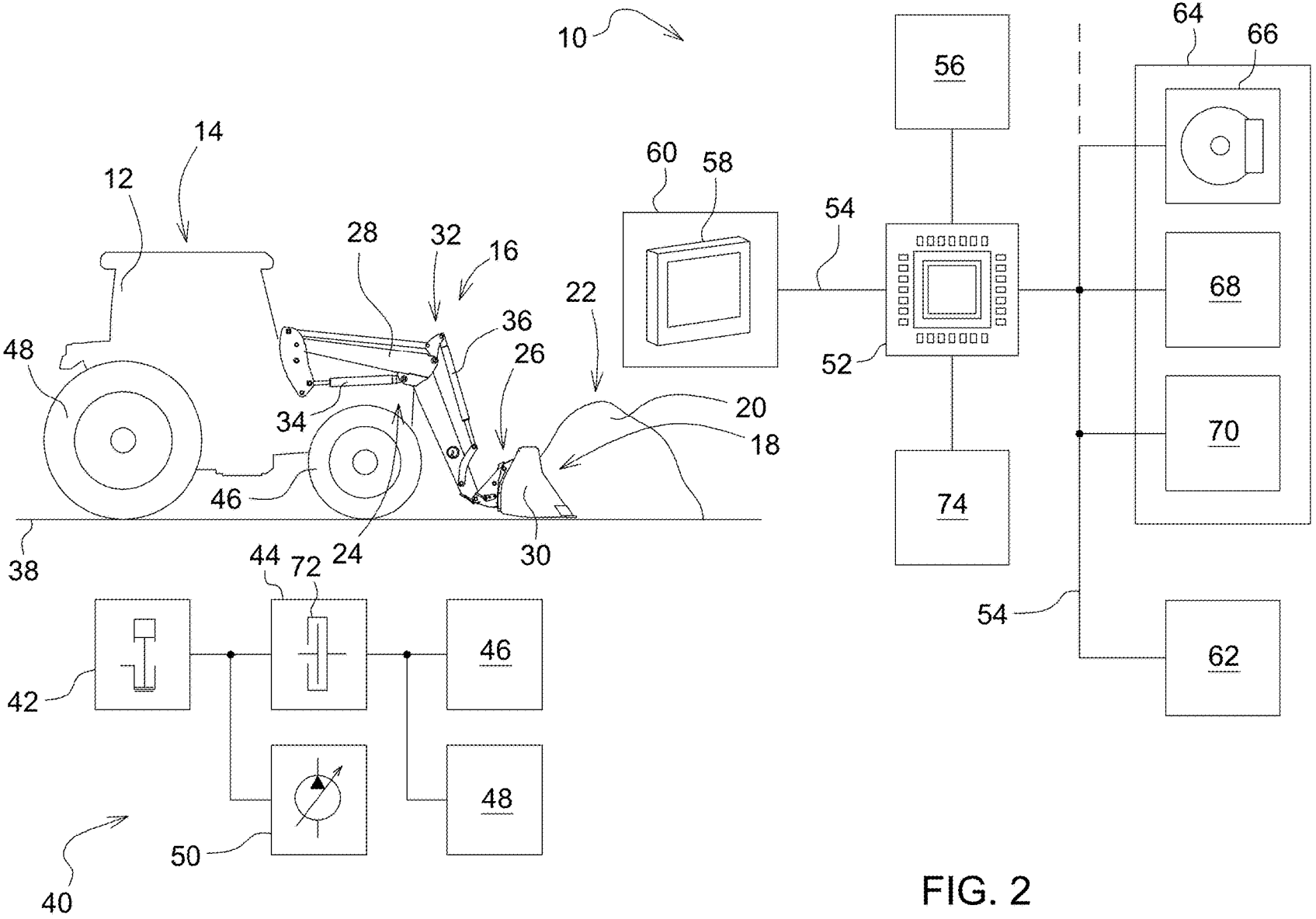
FIG. 2 shows a schematically illustrated arrangement for carrying out the method according to the disclosure.

FIG. 1 shows an example embodiment, illustrated as a flow diagram, of the method according to the disclosure for supporting a loading operation with a front loader, wherein this method will be described below with reference to the arrangement according to FIG. 2 provided for carrying it out.

Starting from FIG. 2, the arrangement 10 is a component part of a utility vehicle 14, which is designed as an agricultural tractor 12 and has a front loader 16 arranged thereon, wherein the front loader 16 is attached as a removable accessory unit in the front region of the agricultural tractor 12 and comprises a loading tool 18 for picking up a load material 20 from a load material supply 22 and a hydraulically adjustable loader linkage 24 for pivoting and for raising and lowering the loading tool 18.

In some embodiments, the front loader 16 is used to transfer, inter alia, bulk load material 20, for which purpose the loading tool 18 is designed in the present case as a bucket 30 located on a free end 26 of the front loader 16 or a loader boom 28. The bucket 30 can be adjusted in height relative to the ground 38 and in its inclination about a pivoting axis running transversely to the longitudinal extent of the agricultural tractor 12 by actuating hydraulic actuating devices 32 in the form of associated hydraulic cylinders 34, 36, which are component parts of the loader linkage 24, thus allowing selective penetration of the bucket 30 into the load material supply 22 for the purpose of filling the bucket 30. The load material 20 comprises, for example, bulk materials such as cereals, maize, gravel, sand, soil, or the like.

Furthermore, an internal combustion engine 42 used as a travel drive 40 is connected via a vehicle transmission 44 to driven front and/or rear wheels 46, 48 of the agricultural tractor 12. The internal combustion engine 42 is simultaneously used to operate a hydraulic system 50 of the agricultural tractor 12, which inter alia supplies the hydraulic actuating devices 32 of the front loader 16 with hydraulic energy.

As can likewise be seen in FIG. 2, the arrangement 10 comprises a microprocessor-controlled control unit 52, which communicates via a CAN databus 54 with an internal memory unit 56 and with a user interface 60 designed as a touch-sensitive display 58.

In addition, there is a hydraulic control system 62 for the actuation of the hydraulic actuating devices 32 of the front loader 16, and a drive and/or brake management system 64, which allows both selective actuation of associated wheel brake devices 66 of the agricultural tractor 12 and communication with an engine or transmission controller 68, 70 provided for the operation of the internal combustion engine 42 and/or vehicle transmission 44. The transmission controller 70 makes it possible, in the event that the agricultural tractor 12 is fitted with a CVT or shift transmission, for the control unit 52 to interrupt the drive connection to the driven front and/or rear wheels 46, 48 by opening a travel clutch 72.

Feedback in respect of the state of actuation of the loader linkage 24 is provided to the control unit 52 by means of a plurality of sensors, which are combined in a function block 74 in FIG. 2 and which serve to detect the pressure conditions in the hydraulic cylinders 34, 36 provided for the adjustment of the loader linkage 24 or to detect actuating torques occurring at the loader linkage 24, in each case on the basis of the instantaneous position thereof.

In accordance with the flow diagram shown in FIG. 1, the method executed by the control unit 52 and stored as corresponding program code in the internal memory unit 56 is started by the user in a starting step 100 by calling up a loading assistance mode via the touch-sensitive display 58 of the user interface 60, whereupon, in a first main step 102, on the basis of information supplied by the drive and/or brake management system 64, the control unit 52 checks whether a reverse gear has been selected or the wheel brake devices 66 are currently being actuated. If this is the case, the method returns to the start via an intermediate step 104 in order to be run through again. Otherwise, the program continues with a second main step 106, in which the control unit 52 additionally checks whether a travel state that indicates instantaneous or intended forward travel of the agricultural tractor 12 is present, this being recognized by the control unit 52 by observation of characteristic indications in the form of travel-related driver actions, such as gas pedal or travel lever actuation with a forward gear selected or by evaluation of the direction of rotation of the front and/or rear wheels 46, 48 of the agricultural tractor 12. The relevant information is detected by sensors and made available to the control unit 52 via the CAN databus 54. If such a travel state is present, the program continues with a third main step 108, in which the control unit 52 checks whether this would lead to a potential overload state of the travel drive 40 provided for carrying out forward travel. Otherwise, in this case too, the method returns to the first main step 102 in order to be run through again.

In some embodiments, in the third main step 108, the control unit 52 infers a potential overload state of the travel drive 40 if a resistance posed to the bucket 30 as the load material 20 is picked up exceeds an overload-specific limit value. If the travel drive 40 comprises an internal combustion engine 42, as in the present case, the overload-specific limit value is chosen on the basis of an engine characteristic presupposed as known and stored in the engine controller 68, more specifically such that the limit value is characteristic of imminent stalling of the internal combustion engine 42. The latter is the case when the engine speed to be expected from the injected fuel quantity on the basis of the engine characteristic is not achieved or is undershot.

The control unit 52 derives the resistance posed to the bucket 30 as the load material 20 is picked up by evaluating the sensor-detected pressure conditions in the hydraulic cylinders 34, 36 provided for the adjustment of the loader linkage 24 and/or the sensor-detected actuating torques at the loader linkage 24, in each case on the basis of the instantaneous position of the loader linkage 24 and thus of the leverage ratios resulting therefrom. The sensor detection of the actuating torques is accomplished by means of strain gages (not shown) positioned at suitable points in the loader linkage 24. As an option, the control unit 52 performs an assessment of changes in axle load occurring in this context at a front axle of the agricultural tractor 12, in particular also by observing a change thus brought about in the tire pressure in the front wheels 46.

If it is found in the third main step 108 that the overload-specific limit value is exceeded, then, in a fourth main step 110, the agricultural tractor 12 is put into a drive-neutral stationary state; otherwise, the method continues immediately with the intermediate step 104 in order to begin from the start.

To implement the drive-neutral stationary state, provision is made in the fourth main step 110, at the instigation of the control unit 52, for the drive and/or brake management system 64 to be controlled in such a way that an interruption in the drive connection between the travel drive 40 and the driven front and/or rear wheels 46, 48 of the agricultural tractor 12 is brought about by opening the travel clutch 72 by means of the transmission controller 70 while substantially simultaneously actuating the wheel brake devices 66 in a fifth main step 112. If, instead of being a CVT or shift transmission, the vehicle transmission 44 is an IVT transmission, the travel clutch 72 is omitted, and, in this case, the drive-neutral stationary state is achieved by selecting the "infinite" transmission ratio.

In general terms, the drive-neutral stationary state is distinguished by the fact that the driven front and/or rear wheels 46, 48 of the agricultural tractor 12 are free from driving torques. The actuation of the wheel brake devices 66 ensures that the agricultural tractor 12 cannot roll away in this state.

It is furthermore envisaged that, in the loading assistance mode, the control unit 52 prevents the execution of the loading operation by intervening in the hydraulic control system 62 at least until achievement of the drive-neutral stationary state has been detected. The hydraulic control system 62 is then enabled in a sixth main step 114, such that the loading operation can be continued by the driver. In addition, the drive-neutral stationary state is cancelled as soon as the control unit 52 detects that a potential overload state of the travel drive 40 is no longer to be expected. In this case, forward travel can be resumed in order to penetrate further into the load material 20 by means of the bucket 30, wherein the loading assistance mode continues to be active. If a potential overload state of the travel drive 40 is detected again, the process described above begins again from the start. This repeated process leads to the load material 20 being picked up bit by bit by means of the bucket 30 and, to this extent, can also be characterized as "ratchet digging".

In addition, in the loading assistance mode, driver information that indicates the potential overload state of the travel drive 40 is output by means of the user interface 60 that can be driven by the control unit 52, wherein the output of the driver information is cancelled or modified when achievement of the drive-neutral stationary state is detected. According to the example, the driver information is output in the form of a traffic light, which is shown on the display 58 of the user interface 60 and which switches from red to green when the functional limitation is lifted, and vice versa. Such a way of displaying information can be particularly easy for the driver to grasp intuitively.

After this, the method returns to the beginning via the intermediate step 104.

The outcome is that the agricultural tractor 12 is automatically put and kept in a drive-neutral stationary state by intervening in the drive and/or brake management system 64. This makes it possible to execute the loading operation with the front loader 16 without the possibility that the resistance posed to the bucket 30 as it drives or penetrates into the load material 20 will exceed the capacity of the internal combustion engine 42 used as the travel drive 40.

For the sake of completeness, it may be observed that the front loader 16 may also be designed as a bucket excavator, a telescopic loader or some other corresponding loading vehicle from the construction or agricultural sector.

The terminology used herein is for the purpose of describing example embodiments or implementations and is not intended to be limiting of the disclosure. As used herein, the singular forms "a," "an," and "the" are intended to include the plural forms as well, unless the context clearly indicates otherwise. It will be further understood that the any use of the terms "has," "includes," "comprises," or the like, in this specification, identifies the presence of stated features, integers, steps, operations, elements, and/or components, but does not preclude the presence or addition of one or more other features, integers, steps, operations, elements, components, and/or groups thereof.

Those having ordinary skill in the art will recognize that terms such as "above," "below," "upward," "downward," "top," "bottom," etc., are used descriptively for the drawings, and do not represent limitations on the scope of the present disclosure, as defined by the appended claims. Furthermore, the teachings may be described herein in terms of functional and/or logical block components or various processing steps, which may include any number of hardware, software, and/or firmware components configured to perform the specified functions.

Terms of degree, such as "generally," "substantially," or "approximately" are understood by those having ordinary skill in the art to refer to reasonable ranges outside of a given value or orientation, for example, general tolerances or positional relationships associated with manufacturing, assembly, and use of the described embodiments or implementations.

As used herein, "e.g.," is utilized to non-exhaustively list examples and carries the same meaning as alternative illustrative phrases such as "including," "including, but not limited to," and "including without limitation." Unless otherwise limited or modified, lists with elements that are separated by conjunctive terms (e.g., "and") and that are also preceded by the phrase "one or more of" or "at least one of" indicate configurations or arrangements that potentially include individual elements of the list, or any combination thereof. For example, "at least one of A, B, and C" or "one or more of A, B, and C" indicates the possibilities of only A, only B, only C, or any combination of two or more of A, B, and C (e.g., A and B; B and C; A and C; or A, B, and C).

While the above describes example embodiments or implementations of the present disclosure, these descriptions should not be viewed in a restrictive or limiting sense. Rather, there are several variations and modifications which may be made without departing from the scope of the appended claims.

What is claimed is:

1. A method for supporting a loading operation, in which a front loader is arranged on a utility vehicle and includes a loading tool for picking up a load material and a hydraulically adjustable loader linkage for pivoting and for raising and lowering the loading tool, comprising:

monitoring via a controller during the execution of a loading operation whether a travel state that indicates one of instantaneous or intended forward travel of the utility vehicle would lead to a potential overload state of a travel drive provided for carrying out forward travel;

automatically via the controller put and keep the utility vehicle in a drive-neutral stationary state in a loading assistance mode by intervening in a drive and brake management system when the travel state would lead to the potential overload state; and controlling via the controller the drive and brake management system to implement the drive-neutral stationary state by interrupting a drive connection between the travel drive and a driven wheel of the utility vehicle while actuating an associated wheel brake.

2. The method of claim 1, wherein the controller infers the potential overload state of the travel drive if a resistance posed to the loading tool as the load material is picked up exceeds an overload-specific limit value representative of imminent stalling of an internal combustion engine of the utility vehicle.

3. The method of claim 2, wherein the controller derives the resistance posed to the loading tool as the load material is picked up by evaluating sensor-detected pressure conditions in hydraulic cylinders provided for the adjustment of the loader linkage and sensor-detected actuating torques at the loader linkage, in each case on the basis of the instantaneous position of the loader linkage.

4. The method of claim 3, wherein the controller performs an assessment of changes in axle load occurring at a front axle of the utility vehicle by observing a change in a tire pressure in a front wheel of the utility vehicle.

5. The method of claim 1, wherein, in the loading assistance mode, the controller prevents the execution of the loading operation by intervening in a hydraulic control system until achievement of the drive-neutral stationary state has been detected.

6. The method of claim 1, wherein, in the loading assistance mode, driver information that indicates the potential overload state of the travel drive is output by a user interface that can be driven by the controller, wherein the output of the driver information is one of cancelled or modified when achievement of the drive-neutral stationary state is detected.

7. The method of claim 1, wherein interrupting the drive connection between the travel drive and the driven wheel includes opening a travel clutch.

8. The method of claim 1, wherein interrupting the drive connection between the travel drive and the driven wheel includes selecting an infinite transmission ratio.

9. A system for supporting a loading operation, comprising:

a front loader arranged on a utility vehicle and including a loading tool for picking up a load material and a hydraulically adjustable loader linkage for pivoting and for raising and lowering the loading tool; and a controller configured to monitor during the execution of a loading operation whether a travel state that indicates one of instantaneous or intended forward travel of the utility vehicle would lead to a potential overload state of a travel drive provided for carrying out forward travel, the controller configured to automatically put and keep the utility vehicle in a drive-neutral stationary state in a loading assistance mode by intervening in a drive and brake management system when the travel state would lead to the potential overload state, and the controller configured to control the drive and brake management system to implement the drive-neutral stationary state by interrupting a drive connection between the travel drive and a driven wheel of the utility vehicle while actuating an associated wheel brake.

10. The system of claim 9, wherein the controller infers the potential overload state of the travel drive if a resistance posed to the loading tool as the load material is picked up exceeds an overload-specific limit value representative of imminent stalling of an internal combustion engine of the utility vehicle.

11. The system of claim 10, wherein the controller derives the resistance posed to the loading tool as the load material is picked up by evaluating sensor-detected pressure conditions in hydraulic cylinders provided for the adjustment of the loader linkage and sensor-detected actuating torques at the loader linkage, in each case on the basis of the instantaneous position of the loader linkage.

12. The system of claim 11, wherein the controller performs an assessment of changes in axle load occurring at a front axle of the utility vehicle by observing a change in a tire pressure in a front wheel of the utility vehicle.

13. The system of claim 9, wherein, in the loading assistance mode, the controller prevents the execution of the loading operation by intervening in a hydraulic control system until achievement of the drive-neutral stationary state has been detected.

14. The system of claim 9, wherein, in the loading assistance mode, driver information that indicates the potential overload state of the travel drive is output by a user interface that can be driven by the controller, wherein the output of the driver information is one of cancelled or modified when achievement of the drive-neutral stationary state is detected.

15. The system of claim 9, wherein interrupting the drive connection between the travel drive and the driven wheel includes opening a travel clutch.

16. The system of claim 9, wherein interrupting the drive connection between the travel drive and the driven wheel includes selecting an infinite transmission ratio.

17. A system for supporting a loading operation, comprising:

a front loader arranged on a utility vehicle and including a loading tool for picking up a load material and a hydraulically adjustable loader linkage for pivoting and for raising and lowering the loading tool; and a controller configured to:

monitor during the execution of a loading operation whether a travel state that indicates one of instantaneous or intended forward travel of the utility vehicle would lead to a potential overload state of a travel drive provided for carrying out forward travel, infer the potential overload state if a resistance posed to the loading tool as the load material is picked up exceeds an overload-specific limit value representative of imminent stalling of an internal combustion engine of the utility vehicle, derive the resistance posed to the loading tool by evaluating sensor-detected pressure conditions in hydraulic cylinders provided for the adjustment of the loader linkage and sensor-detected actuating torques at the loader linkage, in each case on the basis of the instantaneous position of the loader linkage, automatically put and keep the utility vehicle in a drive-neutral stationary state in a loading assistance mode by intervening in a drive and brake management system when the travel state would lead to the potential overload state, control the drive and brake management system to implement the drive-neutral stationary state by interrupting a drive connection between the travel drive and a driven wheel of the utility vehicle while actuating an associated wheel brake, and prevent the execution of the loading operation by intervening in a hydraulic control system until achievement of the drive-neutral stationary state has been detected.

* * * * *